US005121526A

United States Patent [19]

Burkard et al.

[11] Patent Number: 5,121,526

[45] Date of Patent: Jun. 16, 1992

[54] INTERCONNECTION CLIP FOR MODEL STRUCTURES

[75] Inventors: Eugene R. Burkard, 1115 Moana Dr., San Diego, Calif. 92107; Angus R. Colson, Jr., Jamul, Calif.

[73] Assignee: Eugene R. Burkard, San Diego, Calif.

[21] Appl. No.: 567,679

[22] Filed: Aug. 15, 1990

[51] Int. Cl.[5] ..... A44B 21/00; A63H 33/00

[52] U.S. Cl. ..... 24/336; 24/337; 446/114

[58] Field of Search ..... 24/336, 337, 329, 338, 24/543, 546, 297; 446/111, 113, 114, 116; 403/170, 174

[56] References Cited

U.S. PATENT DOCUMENTS

| | | | |
|---|---|---|---|
| 1,678,709 | 7/1928 | Schurmann . | |
| 2,251,744 | 8/1941 | Kurath et al. | 24/546 |
| 2,984,935 | 5/1961 | Beck | 446/114 |
| 3,177,611 | 4/1965 | Beck | 446/114 |
| 3,827,177 | 8/1974 | Wengel | 446/116 |
| 3,891,335 | 6/1975 | Feil | 446/114 |
| 4,493,425 | 1/1985 | Yoshida | 211/189 |
| 4,707,892 | 11/1987 | Nelson | 24/336 |
| 4,789,370 | 12/1988 | Ellefson | 446/114 |
| 4,793,725 | 12/1988 | Cheng | 403/174 |
| 4,838,003 | 6/1989 | Zeigler | 52/646 |

FOREIGN PATENT DOCUMENTS

| | | | |
|---|---|---|---|
| 2031289 | 4/1980 | United Kingdom | 446/111 |

*Primary Examiner*—Victor N. Sakran

*Attorney, Agent, or Firm*—Brown, Martin, Haller & McClain

[57] ABSTRACT

The preferred clip is comprised of a hub with four equally spaced arms, each having at least one coin-engaging slot. Coins are retained by frictional engagement and by cooperation between the residual coin rim and ridges in the slots. Structures may be built of coins that are in orthogonal or parallel relationship. Coins of more than one size (denomination) can be retained by a single clip.

13 Claims, 3 Drawing Sheets

FIG. 5
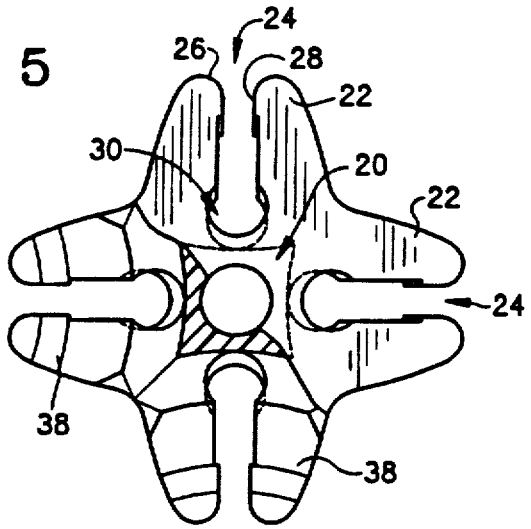
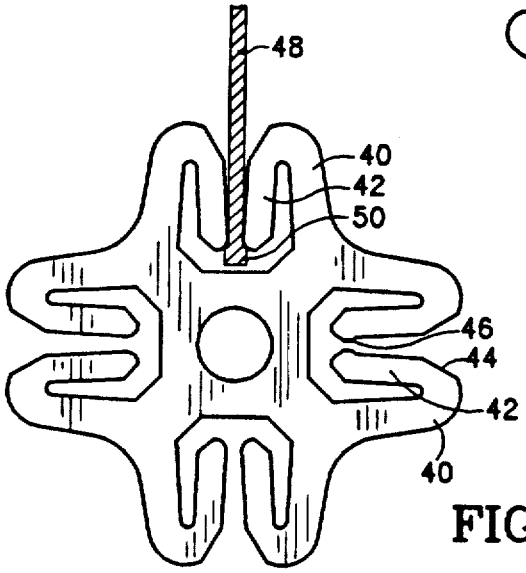
FIG. 6
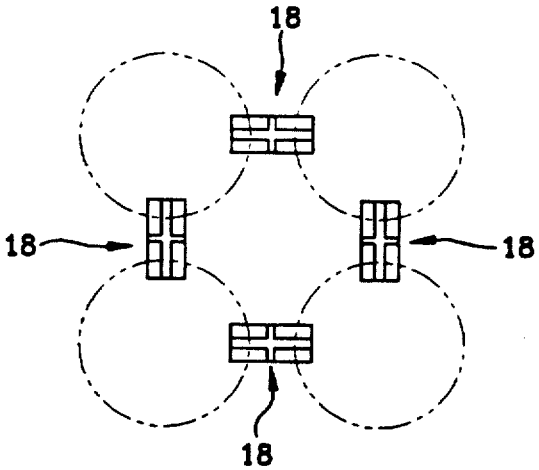
FIG. 7
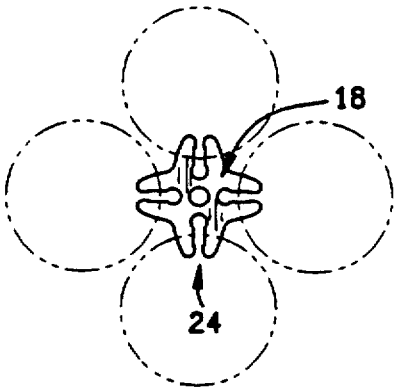
FIG. 8

INTERCONNECTION CLIP FOR MODEL STRUCTURES

BACKGROUND OF THE DISCLOSURE

There is a recognized need to interconnect display elements to create ornamental displays with a recognizable shape, and of considerable size. Many prior interconnection structures have utilized display elements that incorporate integral attachment means. An example would be a traditional children's building block, with integral tongue and groove interfitting structure. The interfitting structure provides at least minimal protection against the accidental disengagement of the blocks, but relies solely upon the force of gravity to maintain adjacent tongue-and-groove structures in engagement. More contemporary building blocks offer at least minimal frictional retention to permit assembling more complex shapes. However, no current design is capable of providing substantial strength in more than two dimensions. The blocks are basically limited to combinations of two dimensional walls. The blocks do not permit assembly of horizontal structures such as roof shapes. These blocks do not readily adapt to incorporating readily available display elements such as cards or discs.

Paper clip structures have been adapted to interconnect between multiple paper panels, such as cards or photographs. The only gripping provided relies, in part, upon the resiliency of the paper that is clamped. If a right angular relationship between adjacent paper panels is desired (such as is required for building solid structures) then two clips must be utilized in a clip-to-clip engagement.

No prior art structures have been provided that can join rigid display elements together. No prior art structure resiliently-retains rigid display elements together in a structural relationship. No prior art structure provides for resiliently retaining rigid display elements together in display-element/clip/display-element right-angular relationship.

It is therefore desirable to provide a structural interconnection clip for display elements that makes possible assembly of complex structures, with recognizable shape and substantial size. Such a clip is particularly to be desired if it may be manufactured at low cost, and may be used to reliably secure together display elements of varying size and thickness.

SUMMARY OF THE DISCLOSURE

An exemplary embodiment of the invention overcomes the limitations of prior art structures by providing a resilient plastic clip, with a plurality of primary slots, which frictionally engage and retain the display elements. In the exemplary embodiment, the favored display elements are common coins. However, it will be recognized that any rigid or substantially rigid element with, at least, protruding tabs having parallel-planer portions which are sized to be accommodated into the slots, may be joined together utilizing the present invention. The clip may be visualized as having a hub from which a plurality of slotted arms radiate. In the exemplary embodiment, four equally spaced arms are provided. The primary slot in each arm is so sized that in its relaxed state (minimum width) it will engage the thinnest coins it is intended to clamp, and in its flexed state it will accommodate the thickest coin, the clip is intended to clamp. For example, a single clip may be sized to accommodate both pennies and dimes.

Coins may be assembled into a solid structure (with all slots internal to the structure accommodating a coin) or may be assembled in hollow structures where at least some of the interior slots are left vacant. The coins may be thought of as being assembled into modules of four coins each. Modules of four parallel-related coins retained by four clips may be used to form flat structures such as walls, or modules of four orthogonally-related coins may be used to build volume. Ledges and steps are created with a minimum one-diameter plus one-clip spacing.

An optional feature of the exemplary clip is a transverse slot in each arm. Utilizing the transverse slot, coins may be assembled into substantially edge-to-edge relationship to form the appearance of solid panels such as roof panels. The transverse slot also may be utilized to form ledges and steps that have a half-diameter spacing.

The primary slots incorporate a coin stop which preferably conforms to the curvature of the largest coin utilized with a selected clip. The slot is chamfered at its opening to reduce the force needed to insert the thickest coin. Inward of the chamfered surface, an engagement surface is provided. The engagement surface is resiliently biased by the flexed arm to provide a substantial area of engagement with opposed surfaces of the coin. The engagement surface incorporates retention ridges that prevent coins from being accidentally withdrawn. Each ridge is curved to correspond to the I.D. of the raised rim on a selected coin.

An alternate embodiment of the invention has slots that are formed by an external tension arm and a reflex engagement finger. This embodiment provides bi-modal flexing to accommodate a wider range of coin thicknesses, such as accommodating dimes, pennies, quarters and nickels. The thinnest coins flex only the tension fingers. The widest coins engage an entry ramp, to flex the tension arms as well.

It is an advantage of the invention that a clip is provided that may be efficiently molded of low cost materials, and yet reliably support large structures. The design is light in weight and minimizes the amount of material required. The clips may be used to assemble display elements in a variety of orientations to produce attractive visual effects. The clip may be made of materials (such as translucent plastic) and shapes (such as spheroid) to compliment the appearance of the display elements.

Other benefits and many attendant advantages of the invention will be apparent upon a reading of the following detailed description of the invention, together with the drawings, in which like reference numerals refer to like parts throughout and in which:

BRIEF DESCRIPTION OF THE DRAWINGS

FIG. 5 is a plan view of the clip with portions cut away to show the retention ridges.

FIG. 6 illustrates an alternative configuration of the clip to accommodate the widest range of coin thicknesses.

FIG. 7 shows the use of 4 clips to secure coins in a planar relationship.

FIG. 8 shows the use of the transverse stop in a clip to arrange coins in an edge-to-edge relationship.

DETAILED DESCRIPTION OF THE DRAWINGS

Figure 1:
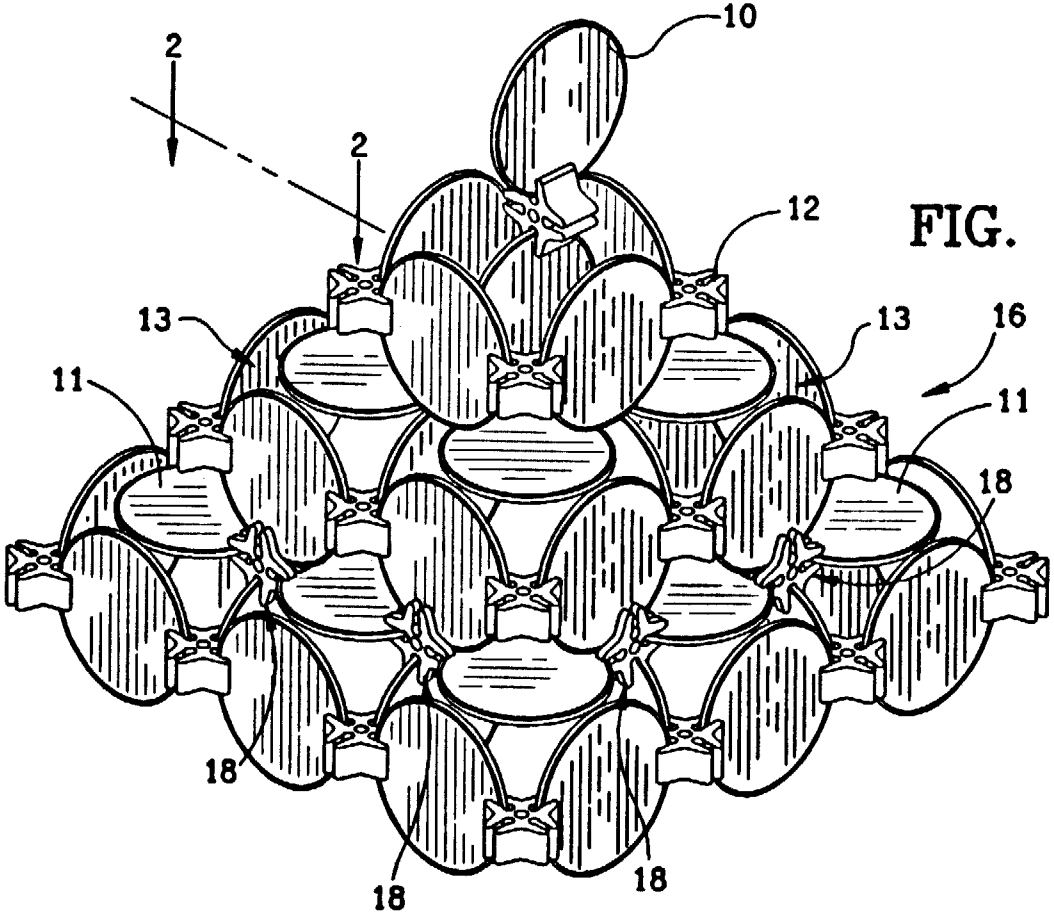
FIG. 1 a perspective view of a pyramidal display structure utilizing the interconnection clip of the invention to support multiple coins.

Referring now to the drawings, and particularly to FIG. 1, there is illustrated a pyramidal structure built with the interconnection clip according to the invention. The structure is shown to comprise a plurality of coins 10, connected by clips 12. The horizontal coins 11 are supported by clips 12 that are hidden from view. Additional clips 12 may optionally be provided at the locations 13. The illustrated configuration permits "half diameter" spacing, for the several levels of the pyramid. Such half diameter spacing may also be provided by using clips with a transverse slot such as will be described in connection with FIG. 5.

Figure 2:
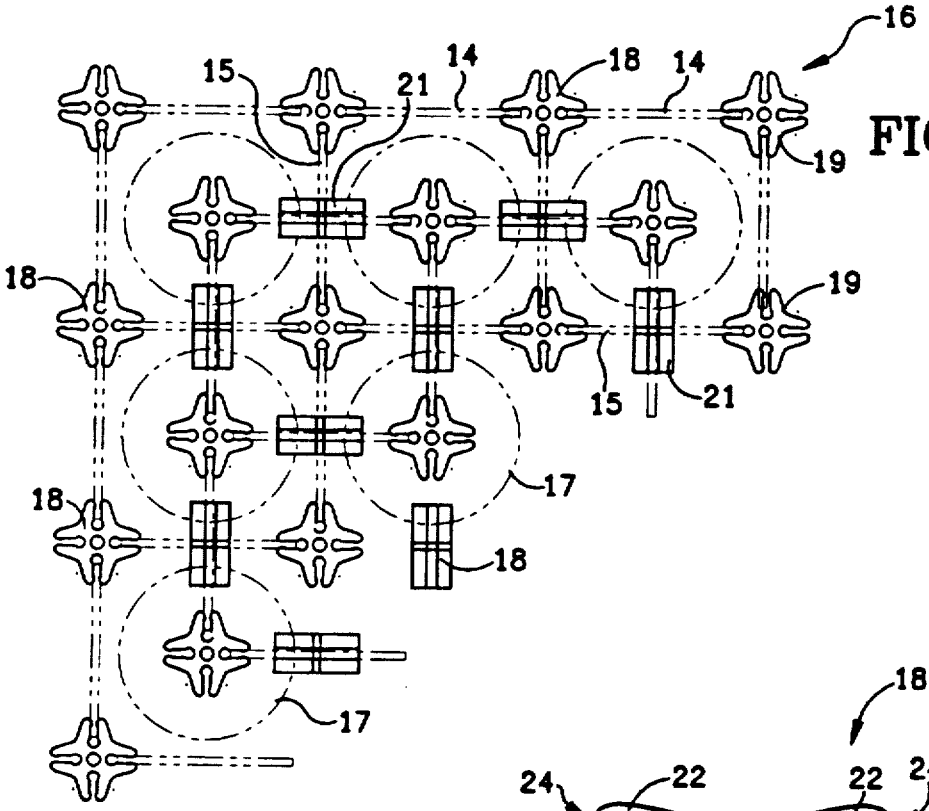
FIG. 2 is a section view taken on line 2—2 of FIG. 1.

The configuration of the clips and coins in FIG. 1 is illustrated in more detail in FIG. 2. A layer 16 is formed of clips 18 with coins 14 lying in vertical planes. Clips 21 are positioned on the interior coins 15 at the half diameter position. The next layer is then built up from coins 17 lying in a common horizontal plane.

Figure 3:
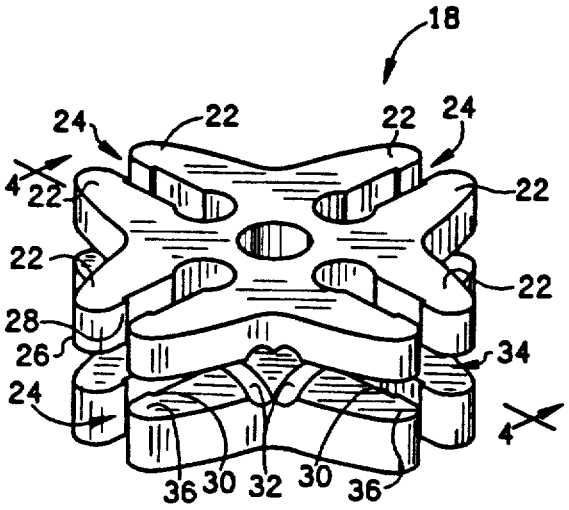
FIG. 3 is a perspective view of a clip according to the invention which includes the optional transverse slot.
Figure 4:
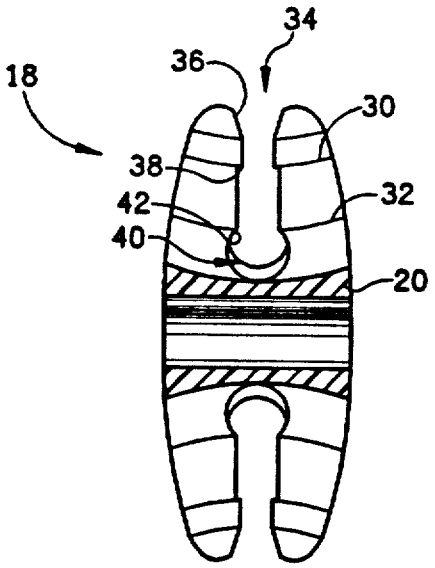
FIG. 4 is a sectional view taken on line 4—4 of FIG. 3.

Turning to FIGS. 3 and 4, the detailed configuration of a coin clip 18 designed to accommodate coins of two different sizes and in primary slots 24 or transverse slots 34 is illustrated. The clip 18 incorporates a hub 20, and a plurality of arms 22, that are orthogonally related and equally spaced. The arms radiate from the hub 20. Primary slots 24 penetrate each of the arms. Each slot 24 is formed with a chamfered entry ramp 26, an engagement surface 28, and a coin stop 30. In FIG. 4, the retention ridges for quarters, ridge 30, and nickels, ridge 32, are shown. These ridges in the engagement surface 28 lodge against the inner rim of the coin and prevent withdrawal of the coin, until substantial force is exerted. The curvature of the retention ridges is sized to match the curvature of the inner diameter of the coin rim.

As will also appear from FIG. 4, the coin stop 40 has a curvature. In this case, the curvature corresponds to the outer diameter of the largest coin accommodated (i.e., a quarter). The configuration of the transverse slot 34 is illustrated in FIG. 4. The chamfered entrance ramp 36, and retention ridge 38, correspond to those features of the primary slot 24. The transverse slots will normally employ a flat coin stop 42. A feature of both transverse and the primary slots is the exit ramp 42, which prevents a fully inserted coin from being locked into the slot, which would prevent even intentional removal of the coin without great difficulty. FIG. 4 also illustrates a variation of this embodiment wherein the hub and arms have a rounded outer conformation.

FIG. 5 illustrates the curvature of the retention ridges 38. The curvature of the ridge is selected to correspond to the curvature of the inner diameter of the inner rim of a selected coin. Since coins in adjacent transverse slots would interfere if the coins were fully inserted, the retention ridge 38 is spaced from the hub 20 an amount such that the coins are grasped by only the outermost surfaces of the slot 34. The use of the transverse slots is further described in connection with the subsequent description of FIG. 8.

Turning to FIGS. 6 and 7, an alternative embodiment of the invention is illustrated. Where it is desired to accommodate the widest possible range of coins, such as the full range from dime to quarter, then maximum flexibility and resiliency are required. According to the invention as shown in the alternative embodiment, the functions of resiliency and engagement are divided between two elements. The function of accommodating the largest coins is primarily provided by an external tension arms 40. The function of coin engagement is primarily provided by a reflex engagement finger 42. As will appear from the engagement of the reflex engagement finger 42, on the surface of the coin 48, the alternative embodiment provides a relatively large area of engagement to securely, frictionally retain coins, regardless of thickness. The flexing of the tension arm 40 allows the engagement finger 42 to maintain parallel engagement. Tension arm 40 is relatively unflexed by the thinnest coins, but flexes as necessary to accommodate the thickest coins. An especially wide chamfered entry ramp 44, accommodates the full range of thicknesses (dimes to nickels.) The rounded protrusion 46 is designed to ride up over and drop behind the coin rim 50, of coin 48, to releasably hold a coin fully inserted into the slot.

Although it is not shown on the alternative embodiment, it is possible to accommodate a transverse slot in the alternative embodiment in a manner comparable to that illustrated in connection with the primary embodiment.

Referring to FIG. 7, four clips 18 are shown holding four coins in a planar relationship. Using this configuration, complex structures may be built utilizing clips 18 that have primary slots only. Such clips are both stronger and less expensive to manufacture.

Referring to FIG. 8, four coins are held in a nearly edge-to-edge relationship by a single clip 18. The configuration is achieved by using the optional transverse slots. Slots 24 are not used in this configuration. It will appear that the provision of optional transverse slots makes it possible to achieve a much more dense planar appearance.

The clips of both embodiments are preferably made of the thermoplastic, elastomer, and may preferably be made of polyurethane elastomer. Such a material is soft to the touch and therefore not irritating to the user who is assembling structures, and yet has sufficient strength and resiliency to frictionally engage and hold the coins against accidental dislodgement.

In use, structures may be assembled utilizing a combination of clips and coin types. The different coin sizes and coloration create variations that allow the user to simulate walls, roofs, windows and similar architectural features of buildings. Other structures, such as the structure of a tractor-trailer truck, can also be built utilizing the coins and auxiliary display elements (in the case of a tractor-trailer, these might include wheel-truck assemblies.) These auxiliary features may be attached directly to the basic structure because of the fact that the exterior-most clip always has a vacant slot. By making auxiliary structures with parallel-planar protrusions that may be received into the slots, virtually any feature of full size structures may be simulated in model form.

The clip, according to the invention, may be utilized to stimulate savings. Specific structures may be predetermined to have a stated amount of coins. By selecting the coin denomination, the user is given a savings goal which will be reached when the structure is completed.

On the other hand, the user may select a structure which is capable of expansion. For example, a pyramid structure, built according to the invention, is inherently capable of expansion. The design of the clip facilitates this expansion by leaving external arms unoccupied by coins so that additional layers of the pyramid may be added on, creating ever larger shapes. Again, the number of coins in a pyramid, comprised by a given number of layers, can be predetermined, and therefore the amount of money which can be saved by the addition of each layer can be preestablished, creating multiple specific goals for the saver to achieve.

The clip, according to the invention, may be utilized to build solid structures which have a maximum content of coins (for maximum savings in a given volume) or may be utilized to build hollow structures which can accommodate interior features, including lighting to accentuate the aesthetic value of the model. It is anticipated that in some applications it may be desirable to build structures utilizing transparent or translucent coin clips, to emphasize the appearance of the coins themselves, and to provide a medium through which interior lighting effects can be communicated. For example, a high rise structure in the generalized form of a specific building, such as the Empire State Building, may be created. The interior volume of the structure may be utilized to create a simulated elevator shaft. By placing sequenced flashing lighting within the shaft, the effect of elevators ascending and descending within the structure may be achieved.

Although the invention has particular advantages when utilized in connection with coins as display elements, the invention is not so limited. Other display elements, made in various overall shapes, may be accommodated by the clip so long as the structures have protrusions with parallelplaner opposed surfaces, sized to be received within the slots of the clips.

Having set forth the specific embodiment in detail, it will be apparent that there are many alterations and variations that may be made without departing from the spirit of the invention, which should be understood and interpreted solely by reference to the appended claims.

Having described our invention, we claim:

1. A structural interconnection clip for joining display elements where the display elements have at least a portion configured as a tab, the tab having a substantially planer and parallel opposed surface comprising:

a clip having a hub;

said hub having an axis;

a plurality of arms protruding from the opposite ends of said hub lying in plane parallel to each other from said hub, each of said arms having a slot wherein one or more retention ridges and stops are disposed in said slot, which ridge is sized to receive and retain the tabs on the structural display elements, and which stop is a depression at the base of the slot sized to correspond to the outer diameter of the largest tab to be retained, a plurality of said slots intersect said axis and are arranged at right angles, one to the other.

2. The structural interconnection clip according to claim 1 wherein:

four arms and slots are provided at 90 degree intervals around said axis.

3. A structural interconnection clip according to claim 1 wherein:

said arms are comprised of flexible material, said arms being flexed by the insertion of the thickest coin that the clip is intended to clamp, and resiliently engaging thinner coins over the range of coin sizes designated for said clip.

4. A structural interconnection clip according to claim 3 wherein:

said slots serve as primary slots, and at least one transverse slot intersecting said primary slot, said transverse slot being adapted to permit the insertion and retention of a display element arranged at right angles to said display elements received in said primary slots and lying along a plane which is at a right angle to a plane lying along said primary slot.

5. A coin interconnection clip for joining a plurality of coins into a display structure comprising:

a clip having a hub;

said hub having an axis;

a plurality of arms radiating from the opposit ends of said hub lying in plane parallel to each other from said hub, each of said arms having at least a primary slot, each of said slots lying on intersecting planes, and each of said intersecting planes passing through said axis of said hub;

said slots comprising means for supporting coins, and to grip and releasably retain at least one denomination of coin.

6. A coin clip according to claim 5 wherein: said engagement of said coins is frictional engagement created by resilient flexing of the arms by which said slot is formed.

7. A coin clip according to claim 5 wherein:

four equally spaced arms and slots are provided.

8. A coin clip according to claim 7 further incorporating:

a coin stop in said slots, to limit the insertion of coins into said slots.

9. A coin clip according to claim 7 Wherein:

each of said slots incorporates an edge retention ridge to engage the rim of said coin and increase the force required for withdrawal of said coin from said slot.

10. A coin clip according to claim 7, further including:

at least one transverse slot intersecting a related primary slot, for receiving a coin lying in a plane at a right angle to the plane for coins received in said primary slot.

11. A coin clip according to claim 10, incorporating:

a transverse slot in each of said arms, each of said transverse slots having sufficient depth that four supported coins may be inserted into said slots and lie in substantial edge-to-edge relationship.

12. A coin clip according to claim 7 wherein:

the entry into said slot at the open end thereof incorporates a chamfered surface to act as an entry ramp to engage the supported coin, and flex said arms as the coin is inserted.

13. A coin clip for joining and supporting a plurality of coins, and comprising:

a clip having a hub, a plurality of arms radiating from the opposit ends of said hub lying in plane parallel to each other from said hub, each of said arms incorporating a slot, the slot in each of said arms lying along a plane which passes through the hub of said clip and which intersects the planes along which the other slots lie, said arms comprising a pair of opposed tension arms, each of said tension arms carrying a dependent, reflex, engagement finger, each of said fingers being substantially parallel to each of said tension arms, whereby coins of the thinnest thickness do not substantially flex said tension arms, but do engage said reflex engagement finger, providing a substantial area of contact with said coin, whereas coins of the thickest dimension designated to be supported by the clip substantially flex said tension arm, and are also engaged by said reflex engagement finger.

* * * * *

UNITED STATES PATENT AND TRADEMARK OFFICE

CERTIFICATE OF CORRECTION

PATENT NO. : 5,121,526

DATED : June 16, 1992

INVENTOR(S) : Eugene R. Burkard and Angus R. Colson, Jr.

It is certified that error appears in the above-identified patent and that said Letters Patent is hereby corrected as shown below:

Column 5, Line 68, "thickest coin" should read --thickest tab--.

Column 6, Line 2, "thinner coins over the range of coin sizes" should read --thinner tabs over the range of tab sizes--.

Column 6, Line 18, "opposit" should read --opposite--.

Column 6, Line 63, "opposit" should read --opposite--.

Signed and Sealed this

Twenty-seventh Day of May, 1997

*Attest:*

Bruce Lehman

BRUCE LEHMAN

*Attesting Officer*

*Commissioner of Patents and Trademarks*